US007116206B2

(12) United States Patent
Ames et al.

(10) Patent No.: US 7,116,206 B2
(45) Date of Patent: Oct. 3, 2006

(54) HIGH ENERGY TOROIDAL INDUCTOR

(75) Inventors: Jeremy D. Ames, Minneapolis, MN (US); Warren J. Dick, Little Canada, MN (US); Christopher Landergan, Minneapolis, MN (US); Alan R. Sunnarborg, Robbinsdale, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 10/976,173

(22) Filed: Oct. 28, 2004

(65) Prior Publication Data

US 2006/0091990 A1 May 4, 2006

(51) Int. Cl.
*H01F 27/28* (2006.01)

(52) U.S. Cl. ..... 336/229; 376/142; 335/216

(58) Field of Classification Search ..... 336/229
See application file for complete search history.

(56) References Cited

U.S. PATENT DOCUMENTS 3,736,539 A * 5/1973 File et al. ..... 335/216
4,263,096 A * 4/1981 Ohkawa et al. ..... 376/142
4,530,812 A * 7/1985 Perkins et al. ..... 376/142
4,664,868 A * 5/1987 Kuno et al. ..... 376/142
5,912,610 A 6/1999 Marinos et al.
6,054,913 A * 4/2000 Leuer ..... 335/229

* cited by examiner

*Primary Examiner*—Joselito Baisa
(74) *Attorney, Agent, or Firm*—Patterson, Thuente, Skaar & Christensen, P.A.

(57) ABSTRACT

A high energy toroidal inductor addresses not only the desire for reduced weight and volume, but also the desire for minimal stray magnetic fields. Specifically, the high energy toroidal inductor includes a bucking cylinder and a predetermined number of leaves. Each leaf is of a two-ended, twisted ring configuration and includes a top portion. The top portion is the narrowest portion of the leaf, and the width of the leaf graduates outward from the top portion to each end of the ring. The bucking cylinder interfaces with each of the leaves and presents the leaves in a side-by-side, continuous toroidal configuration.

10 Claims, 11 Drawing Sheets

Fig. 9 - Table 4

VARYING THICKNESS
HARD DRAWN Cu

| SECTION | LENGTH, m | WIDTH, m | ACTUAL THICKNESS, m | MASS, kg | RESISTANCE, OHMS |
|---|---|---|---|---|---|
| 8 | 0.02284 | 0.01 | 1.80E-02 | 3.66E-02 | 2.16E-06 |
| 27 | 0.02284 | 0.01 | 1.75E-02 | 3.56E-02 | 2.22E-06 |
| 26 | 0.02284 | 0.012 | 1.60E-02 | 3.90E-02 | 2.02E-06 |
| 25 | 0.02284 | 0.018 | 1.40E-02 | 5.12E-02 | 1.54E-06 |
| 24 | 0.02284 | 0.024 | 1.20E-02 | 5.85E-02 | 1.35E-06 |
| 23 | 0.02284 | 0.031 | 9.50E-03 | 5.99E-02 | 1.32E-06 |
| 22 | 0.02284 | 0.038 | 7.00E-03 | 5.41E-02 | 1.46E-06 |
| 21 | 0.02284 | 0.043 | 5.00E-03 | 4.37E-02 | 1.81E-06 |
| 20 | 0.02284 | 0.047 | 4.50E-03 | 4.30E-02 | 1.84E-06 |
| 19 | 0.02284 | 0.049 | 3.50E-03 | 3.49E-02 | 2.26E-06 |
| TOTAL | | | | 0.9129125 | 3.59422E-05 dV AT 100 KA |
| TOTAL x 18 | | | | 16.432425 kg<br>36 lb TOTAL | 0.000646959 64.6959V* |

*VOLTAGE DROP
FROM RESISTANCE
ONLY

Fig. 9 - Table 5

CONSTANT THICKNESS
HARD DRAWN Cu

| SECTION | LENGTH, m | WIDTH, m | ACTUAL THICKNESS, m | MASS, kg | RESISTANCE, OHMS |
|---|---|---|---|---|---|
| 8 | 0.02284 | 0.01 | 1.80E-02 | 3.66E-02 | 2.16E-06 |
| 27 | 0.02284 | 0.01 | 1.80E-02 | 3.66E-02 | 2.16E-06 |
| 26 | 0.02284 | 0.012 | 1.80E-02 | 4.39E-02 | 1.80E-06 |
| 25 | 0.02284 | 0.018 | 1.80E-02 | 6.59E-02 | 1.20E-06 |
| 24 | 0.02284 | 0.024 | 1.80E-02 | 8.78E-02 | 8.99E-07 |
| 23 | 0.02284 | 0.031 | 1.80E-02 | 1.13E-01 | 6.96E-07 |
| 22 | 0.02284 | 0.038 | 1.80E-02 | 1.39E-01 | 5.68E-07 |
| 21 | 0.02284 | 0.043 | 1.80E-02 | 1.57E-01 | 5.02E-07 |
| 20 | 0.02284 | 0.047 | 1.80E-02 | 1.72E-01 | 4.59E-07 |
| 19 | 0.02284 | 0.049 | 1.80E-02 | 1.79E-01 | 4.40E-07 |
| | | | | 2.063658 | 2.17467E-05 dV AT 100 KA |
| TOTAL | | | | 37.145843 kg | 0.000391441 39144V |
| TOTAL x 18 | | | | 81 lb TOTAL | |

Fig. 9 - Table 6

VARYING THICKNESS
6061 Al

| SECTION | LENGTH, m | WIDTH, m | ACTUAL THICKNESS, m | MASS, kg | RESISTANCE, OHMS |
|---|---|---|---|---|---|
| 8 | 0.02284 | 0.01 | 0.0215 | 0.0132586 | 4.25E-06 |
| 27 | 0.02284 | 0.01 | 0.02 | 0.0123336 | 4.57E-06 |
| 26 | 0.02284 | 0.012 | 0.019 | 0.0140603 | 4.01E-06 |
| 25 | 0.02284 | 0.018 | 0.017 | 0.0188704 | 2.99E-06 |
| 24 | 0.02284 | 0.024 | 0.015 | 0.0222005 | 2.54E-06 |
| 23 | 0.02284 | 0.031 | 0.012 | 0.0229405 | 2.46E-06 |
| 22 | 0.02284 | 0.038 | 0.009 | 0.0210905 | 2.67E-06 |
| 21 | 0.02284 | 0.043 | 0.008 | 0.0212138 | 2.66E-06 |
| 20 | 0.02284 | 0.047 | 0.0065 | 0.0188396 | 2.99E-06 |
| 19 | 0.02284 | 0.049 | 0.006 | 0.0181304 | 3.11E-06 |
| | | | | 0.3658762 | 6.445767E-05 dV AT 100 KA |
| TOTAL | | | | 6.5857724 Kg | 0.001160236 116.024V |
| TOTAL x 18 | | | | 14 lb TOTAL | |

Fig. 9 - Table 7

CONSTANT THICKNESS
6061 Al

| SECTION | LENGTH, m | WIDTH, m | ACTUAL THICKNESS, m | MASS, kg | RESISTANCE, OHMS |
|---|---|---|---|---|---|
| 8 | 0.02284 | 0.01 | 0.0215 | 0.0132586 | 4.25E-06 |
| 27 | 0.02284 | 0.01 | 0.0215 | 0.0132586 | 4.25E-06 |
| 26 | 0.02284 | 0.012 | 0.0215 | 0.0159103 | 3.54E-06 |
| 25 | 0.02284 | 0.018 | 0.0215 | 0.0238655 | 2.36E-06 |
| 24 | 0.02284 | 0.024 | 0.0215 | 0.0318207 | 1.77E-06 |
| 23 | 0.02284 | 0.031 | 0.0215 | 0.0411017 | 1.37E-06 |
| 22 | 0.02284 | 0.038 | 0.0215 | 0.0503828 | 1.12E-06 |
| 21 | 0.02284 | 0.043 | 0.0215 | 0.0570121 | 9.88E-07 |
| 20 | 0.02284 | 0.047 | 0.0215 | 0.0623155 | 9.04E-07 |
| 19 | 0.02284 | 0.049 | 0.0215 | 0.0649672 | 8.67E-07 |
| | | | | 0.7477862 | 4.28389E-05 dV AT 100 KA |
| TOTAL | | | | 13.460151 Kg | 0.0007711 77.11V |
| TOTAL x 18 | | | | 30 lb TOTAL | |

Fig. 9 - Table 8

VARYING THICKNESS
2014 Al

| SECTION | LENGTH, m | WIDTH, m | ACTUAL THICKNESS, m | MASS, kg | RESISTANCE, OHMS |
|---|---|---|---|---|---|
| 8 | 0.02284 | 0.01 | 0.0136 | 0.0086975 | 7.22147E-06 |
| 27 | 0.02284 | 0.01 | 0.0136 | 0.0086975 | 7.22147E-06 |
| 26 | 0.02284 | 0.012 | 0.0115 | 0.0088254 | 7.11681E-06 |
| 25 | 0.02284 | 0.018 | 0.01 | 0.0115114 | 5.45622E-06 |
| 24 | 0.02284 | 0.024 | 0.0085 | 0.0130462 | 4.81431E-06 |
| 23 | 0.02284 | 0.031 | 0.007 | 0.0138776 | 4.5259E-06 |
| 22 | 0.02284 | 0.038 | 6.00E-03 | 0.0145811 | 4.30754E-06 |
| 21 | 0.02284 | 0.043 | 4.50E-03 | 0.0123747 | 5.07556E-06 |
| 20 | 0.02284 | 0.047 | 3.50E-03 | 0.0105201 | 5.97033E-06 |
| 19 | 0.02284 | 0.049 | 3.00E-03 | 0.0094009 | 6.68109E-06 |
| | | | | 0.2230646 | 0.000116781 dV AT 100 KA |
| TOTAL | | | | 4.0151624 Kg | 0.002102066 210.207V |
| TOTAL x 18 | | | | 9 lb TOTAL | |

Fig. 9 - Table 9

CONSTANT THICKNESS
2014 Al

| SECTION | THICKNESS, | LENGTH, m | WIDTH, m | MASS, kg | RESISTANCE, OHMS | |
|---|---|---|---|---|---|---|
| 8 | 0.0136 | 0.02284 | 0.01 | 0.0086975 | 7.22147E-06 | |
| 27 | 0.0136 | 0.02284 | 0.01 | 0.0086975 | 7.22147E-06 | |
| 26 | 0.0136 | 0.02284 | 0.012 | 0.010437 | 6.01789E-06 | |
| 25 | 0.0136 | 0.02284 | 0.018 | 0.0156554 | 4.01193E-06 | |
| 24 | 0.0136 | 0.02284 | 0.024 | 0.0208739 | 3.00895E-06 | |
| 23 | 0.0136 | 0.02284 | 0.031 | 0.0269622 | 2.32951E-06 | |
| 22 | 0.0136 | 0.02284 | 0.038 | 0.0330504 | 1.90039E-06 | |
| 21 | 0.0136 | 0.02284 | 0.043 | 0.0373991 | 1.67941E-06 | |
| 20 | 0.0136 | 0.02284 | 0.047 | 0.0408781 | 1.53648E-06 | |
| 19 | 0.0136 | 0.02284 | 0.049 | 0.0426176 | 1.47377E-06 | |
| | | | | 0.4905374 | 7.28025E-05 | dV AT 100 KA |
| TOTAL | | | | 8.8296736 Kg | 0.001310446 | 131.045V |
| TOTAL x 18 | | | | 19 lb TOTAL | | |

HIGH ENERGY TOROIDAL INDUCTOR

FIELD OF THE INVENTION

The present invention relates to inductors used in pulsed power networks and more particularly to a toroidal inductor that can deliver desired electromagnetic characteristics with low mass and minimal stray magnetic fields.

BACKGROUND OF THE INVENTION

In electrical pulsed power applications, inductors are needed for pulse shaping and/or energy storage. In the past helical jelly roll inductors have been used. Helical jelly roll inductors are generally high current inductors constructed by winding long copper strips around an insulating cylinder then overlaying the windings with a layer of fiberglass to withstand internal magnetic pressure. U.S. Pat. No. 5,912,610 entitled "High Energy Inductor", which is hereby incorporated by reference, describes this type of helical jelly roll inductor in detail.

A desirable feature presented by the high energy inductor of the '610 patent is that it is designed to be of sufficient strength to withstand the typically destructive magnetic field forces that result from high pulse current flow while still presenting an inductor of smaller weight and volume. In brief, high energy pulses, which involve high currents, generate such high magnetic field forces that an inductor can literally explode unless fabricated in a fashion to provide high mechanical strength. Typically, this requires that the inductor be of substantial weight and volume. However, the high energy inductor of the '610 patent was able to limit the weight and volume of the inductor by imposing and maintaining a predetermined level of tensile stress upon the length of the conductor of the inductor.

Thus, while the problems of weight and volume of inductors for electrical pulsed power applications have been addressed in one form, the issue of stray magnetic fields remains a problem. Specifically, helical jelly roll inductors, such as the one described in the '610 patent, have been shown to emit strong magnetic fields that typically exceed MIL-SPEC acceptable limits. These fields can be very harmful to electronic equipment in an armored vehicle or on a ship. Further, large stray magnetic fields create a presence that may be detectable by enemy sensors.

In one attempt to solve the stray field problem, an inductor was created by assembling several helical jelly roll inductor segments into a toroidal geometry ("segmented toroid") by attaching the segments to a central bucking cylinder. The bucking cylinder was designed to resist the implosive forces of the inductor. This "segmented toroid" exhibited significantly lower stray fields but was quite bulky.

SUMMARY OF THE INVENTION

The present invention comprises a high energy toroidal inductor that addresses not only the desire for reduced weight and volume, but also the desire for minimal stray magnetic fields. Specifically, the high energy toroidal inductor includes a bucking cylinder and a predetermined number of leaves. Each leaf is of a two-ended, twisted ring configuration and includes a top portion. The top portion is the narrowest portion of the leaf, and the width of the leaf graduates outward from the top portion to each end of the ring. The bucking cylinder interfaces with each of the leaves and presents the leaves in a side-by-side, continuous toroidal configuration.

The bucking cylinder includes a number of slots equivalent to the number of leaves and each slot is designed to accept the top, or narrowest, portion of each leaf. Each end of each leaf is presented in a flat configuration so as to enable securement of a leaf to the next proximate leaf until a complete toroid is formed. The high energy toroidal inductor may additionally include a top and bottom support ring that is concentric to the bucking cylinder and is secured to each of the leaves. The bucking cylinder and the leaves are preferably manufactured from a light weight aluminum alloy. The high energy toroidal inductor preferably creates a stray magnetic field, at a 10 inch standoff, of less than 0.5 Tesla.

A method of assembling a high energy toroidal inductor includes the steps of: (1) inserting a top portion of each of a predetermined number of leaves into one of a plurality of slots about a circumference of a bucking cylinder; (2) securing each of the leaves to the next proximate one of the leaves to form a continuous toroid configuration; and (3) securing a support ring, that is concentric with the bucking cylinder, to both the top and bottom of each of the leaves.

DESCRIPTION OF THE DRAWINGS

FIG. 9 provides Tables 4–9

DESCRIPTION OF THE PREFERRED EMBODIMENTS

A high energy toroidal inductor of the present invention is an inductor of small weight and volume that is capable of handling high electromagnetic forces, as well as an inductor having minimal stray magnetic fields, making it especially suitable to electrical pulse power applications.

The high energy toroidal inductor provides the same electromagnetic characteristics as the "segmented toroid" (described in the background) but with much lower mass. In the high energy toroidal inductor, each winding is designed to be self-supporting against the internal magnetic pressure, only requiring a small lightweight support ring on the top and bottom of the toroid. These rings also reduce the radially inward forces on the central bucking cylinder. Thus, the bucking cylinder is made smaller reducing the overall weight of the high energy toroidal inductor.

Figure 1:
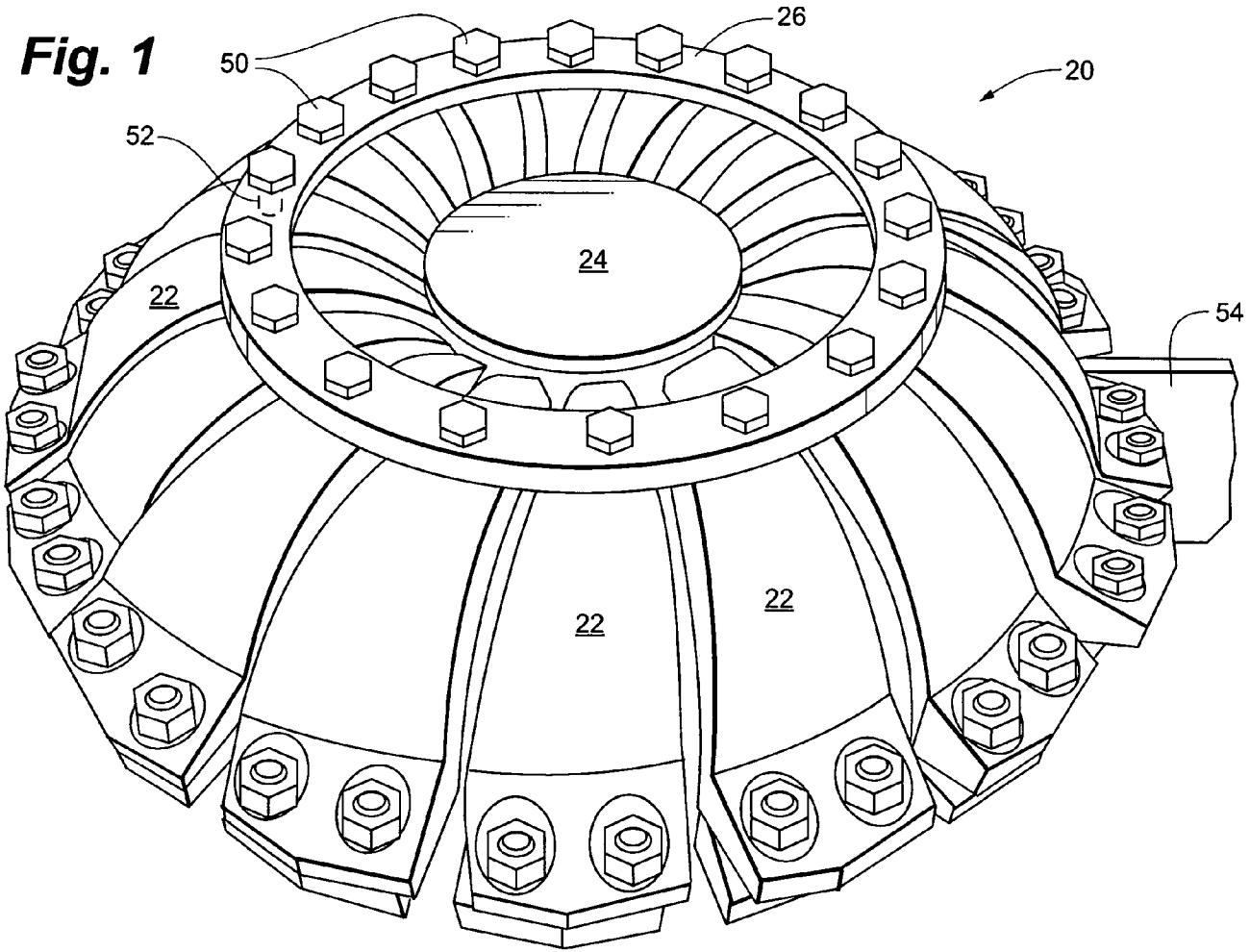
FIG. 1 depicts the high energy toroidal inductor of the present invention.

FIG. 1 depicts the high energy toroidal inductor (HETI) 20 of the present invention. As shown, the HETI 20 includes a plurality of leaves 22, a central bucking cylinder 24, a top support ring 26, and a bottom support ring (not shown) that is identical to the top support ring.

Figure 2:
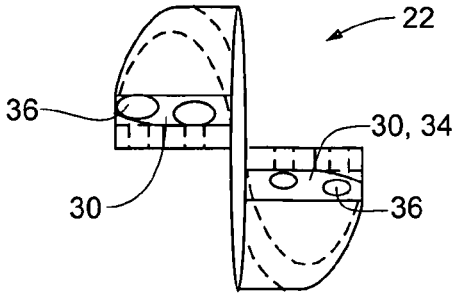
FIG. 2 provides a front view of a leaf of the high energy toroidal inductor.
Figure 3:
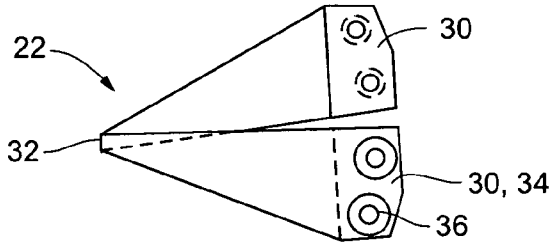
FIG. 3 provides a top view of the leaf of FIG. 2.
Figure 4:
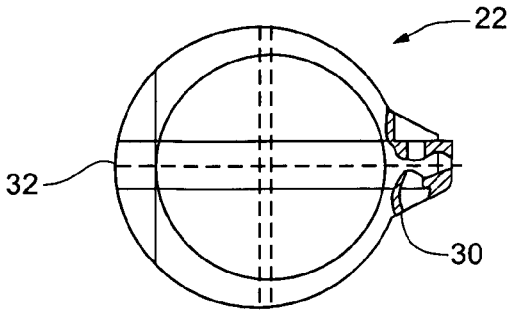
FIG. 4 provides a side view of the leaf of FIG. 2.

Referring to FIGS. 2–4, the details of the leaves 22 may be appreciated. As shown, each leaf 22 is of a ring configuration wherein the ends 30 of the ring are offset from each other so as to enable attachment of one leaf 22 to the next proximate leaf 22. Notably, the top 32 of the leaf presents the narrowest portion of the leaf 22 with the width expanding outward from the top to the offset ends 30 of the ring. Each end 30 of the ring is provided with a flat securement member 34, having a plurality of bores 36 therein.

Figure 5:
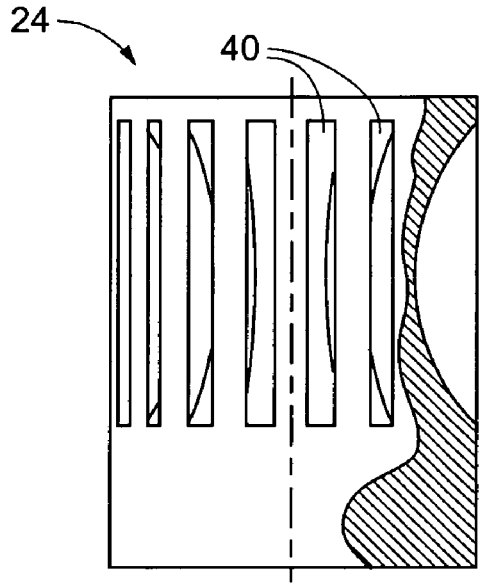
FIG. 5 provides a side view of the bucking cylinder of the toroidal inductor.
Figure 6:
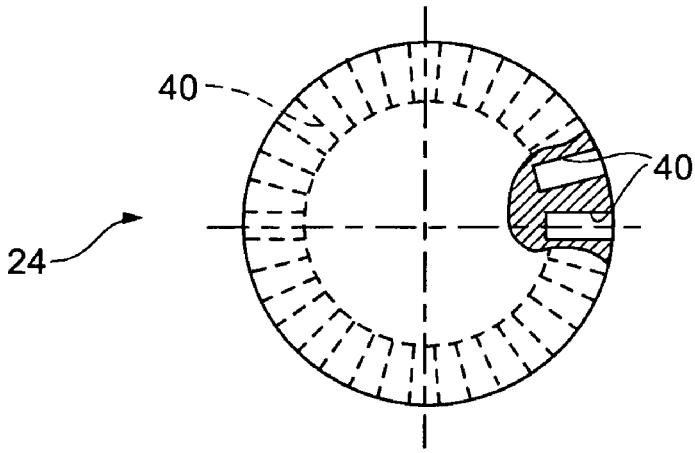
FIG. 6 provided a top view of the bucking cylinder of FIG. 5
Figure 7:
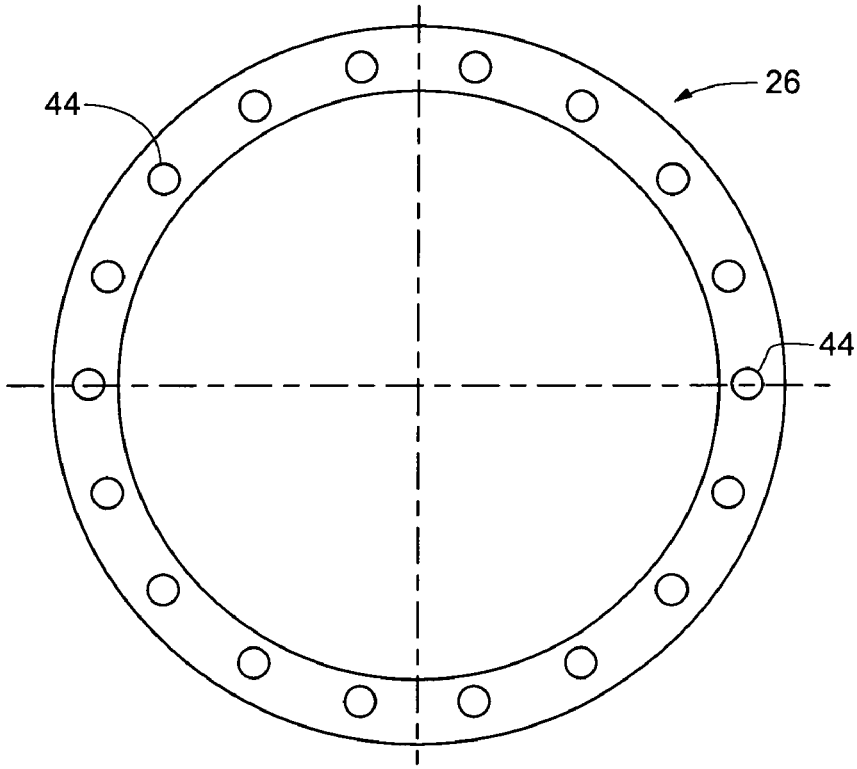
FIG. 7 provides a top view of the top/bottom support ring of the toroidal inductor.

The bucking cylinder 24 is best seen in FIGS. 5 and 6. As shown, the bucking cylinder 24 is provided with a plurality of equidistantly spaced slots 40 positioned around the circumference of the cylinder. The slots 40 are sized to receive the narrow, top portion 32 of the leaf 22. The support ring 26 is shown in FIG. 7 and includes a plurality of bores 44 spaced equidistantly about the circumference of the ring.

To assemble the HETI, each leaf 22 is positioned within a slot 40 of the bucking cylinder 24 and is secured to the both the top and bottom support rings 26 through use of a bolt 50 and bolt insulator 52. The next leaf 22 is positioned similarly proximate the first leaf 22 and is secured to the top and bottom support rings. An insulator is placed intermediate the overlapping ends of the proximate leaves and the ends are secured with bolts. A standoff insulator 54 is provided for external connections.

Design

In a preferred embodiment, the HETI 20 was designed to carry at least 150 kA. The leaves 22 are of a solid metal having an offset, split ring configuration, and are thin where the forces on the leaf are small and thick where the forces on the leaf are high. The design relies on the hoop strength of the metal to carry the EM force load. In a preferred embodiment of the HETI 20, eighteen leaf segments 22 are preferably provided with each having a nominal diameter of six (6) inches and an inner diameter of approximately three (3) inches. The basic formula for analysis is that of hoop stress, refer to the diagram of FIG. 8, where:

$$A_{interior}=d\times L \quad \text{(Eq. 1)}$$

$$F_{interior}=P\times d\times L \quad \text{(Eq. 2)}$$

$$F_{wall}=\sigma\times 2t\times L \quad \text{(Eq. 3)}$$

where: L≅length into page; P=internal pressure; d=mean diameter of a toroid leaf; sigma=material stress; and t=thickness.

Knowing that $F_{wall}=F_{interior}$, then:

$$d\times L\times P=\sigma 2t\times L \quad \text{(Eq. 4)}$$

then solving for sigma, $$\sigma=\frac{P\times d}{2t} \text{ or } t_{\min}=\frac{P\times d}{2\sigma_{\max}} \quad \text{(Eq. 5)}$$

It is assumed that the outward forces on an inductor leaf act like forces on a sealed pressure vessel, i.e., the internal forces are the magnetic forces rather than the forces of a compressed gas.

The forces, then, may be calculated as follows with reference to FIG. 8:

$$F_{AA}=F_{EE} \quad \text{(Eq. 6)}$$
$$=\frac{1}{2}\begin{bmatrix} F_8\text{Sin}(9)+F_{27}\text{Sin}(27)+F_{26}\text{Sin}(45)+ \\ F_{25}\text{Sin}(63)+F_{24}\text{Sin}(81)+F_{23}\text{Sin}(81)+ \\ F_{22}\text{Sin}(63)+F_{21}\text{Sin}(45)+ \\ F_{20}\text{Sin}(27)+F_{19}\text{Sin}(9) \end{bmatrix}$$

-continued $$F_{AA}=\frac{1}{2}\begin{bmatrix} 2434+6492+6939+6089+4974+ \\ 3889+2900+2008+1178+389 \end{bmatrix} \quad \text{(Eq. 7)}$$

$$F_{AA}=18646\ N \quad \text{(Eq. 8)}$$

$$F_{BB}=F_{DD} \quad \text{(Eq. 9)}$$
$$=\frac{1}{2}\begin{bmatrix} F_{26}\text{Sin}(9)+F_{25}\text{Sin}(27)+F_{24}\text{Sin}(45)+ \\ F_{23}\text{Sin}(63)+F_{22}\text{Sin}(81)+F_{21}\text{Sin}(81)+ \\ F_{20}\text{Sin}(63)+F_{19}\text{Sin}(45)+ \\ F_{19}\text{Sin}(27)+F_{20}\text{Sin}(9) \end{bmatrix}$$

$$F_{BB}=\frac{1}{2}\begin{bmatrix} 1535+3103+3561+3508+3215+ \\ 2805+2312+1761+1130+406 \end{bmatrix} \quad \text{(Eq. 10)}$$

$$F_{BB}=1168\ N \quad \text{(Eq. 11)}$$

$$F_{CC}=F_{23}\text{Sin}(9)+F_{22}\text{Sin}(27)+F_{21}(45)+ F_{20}\text{Sin}(63)+F_{19}\text{Sin}(81) \quad \text{(Eq. 12)}$$

$$F_{CC}=8873.3\ N \quad \text{(Eq. 13)}$$

The forces, $F_{AA}$, $F_{BB}$, $F_{CC}$, $F_{DD}$, and $F_{EE}$, are the forces that tend to pull the leaf 22 apart in tension, like the force in a rubber band. These forces are derived from finite element computer calculations of the magnetic fields in and around the toroid. The sections are always aligned with the axis of the main leaf circle at radial planes. Section AA is 180 degrees away from the bucking cylinder side of the leaf, section BB is 135 degrees away, section CC is 90 degrees away, section DD is 45 degrees away, and section EE is 0 degrees away. A summary of the force calculations is provided below in Table 1.

TABLE 1

| Section | Force, N | Design Force, N | Length, m | Width, m |
|---|---|---|---|---|
| AA | 18646 | 55938 | 0.02284 | 0.01 |
| BB | 11668 | 35004 | 0.02284 | 0.01 |
| CC | 8873 | 26619 | 0.02284 | 0.027 |
| DD | 11668 | 35004 | 0.02284 | 0.044 |
| EE | 18646 | 55938 | 0.02284 | 0.048 |

Next, the minimum thickness for the toroid leaf may be calculated according to Eq. 5 above. Table 2 provides a summary of the minimum thickness, as measured in meters, of each section for various materials including Hard Copper, 2014 Aluminum, 6061 Aluminum, and 7075 Aluminum.

TABLE 2

| Section | Hard CU Min. Thickness | 2014 Al Min. Thickness | 6061 Al Min. Thickness | 7075 Al Min. Thickness |
|---|---|---|---|---|
| AA | 1.70E−02 | 1.36E−02 | 2.07E−02 | 1.17E−02 |
| BB | 1.06E−02 | 8.54E−03 | 1.30E−02 | 7.29E−03 |
| CC | 2.99E−03 | 2.40E−03 | 3.65E−03 | 2.05E−03 |
| DD | 2.41E−03 | 1.94E−03 | 2.95E−03 | 1.66E−03 |
| EE | 3.53E−03 | 2.84E−03 | 4.32E−03 | 2.43E−03 |

A summary of the yield strength, resistivity, and density of each of these materials is provided in Table 3.

TABLE 3

| Property | Hard Cu | 2014 T6 Al | 6061 T6 Al | 7075 T6 Al |
|---|---|---|---|---|
| Yield Strength, Pa | 3.30E+08 | 4.10E+08 | 2.70E+08 | 4.80E+08 |
| Resistivity, ohm*m | 1.70E−08 | 4.30E−08 | 4.00E−08 | 5.20E−08 |

TABLE 3-continued

| Property | Hard Cu | 2014 T6 Al | 6061 T6 Al | 7075 T6 Al |
|---|---|---|---|---|
| Density, Kg/m^3 | 8900 | 2800 | 2700 | 2800 |

Figure 8:
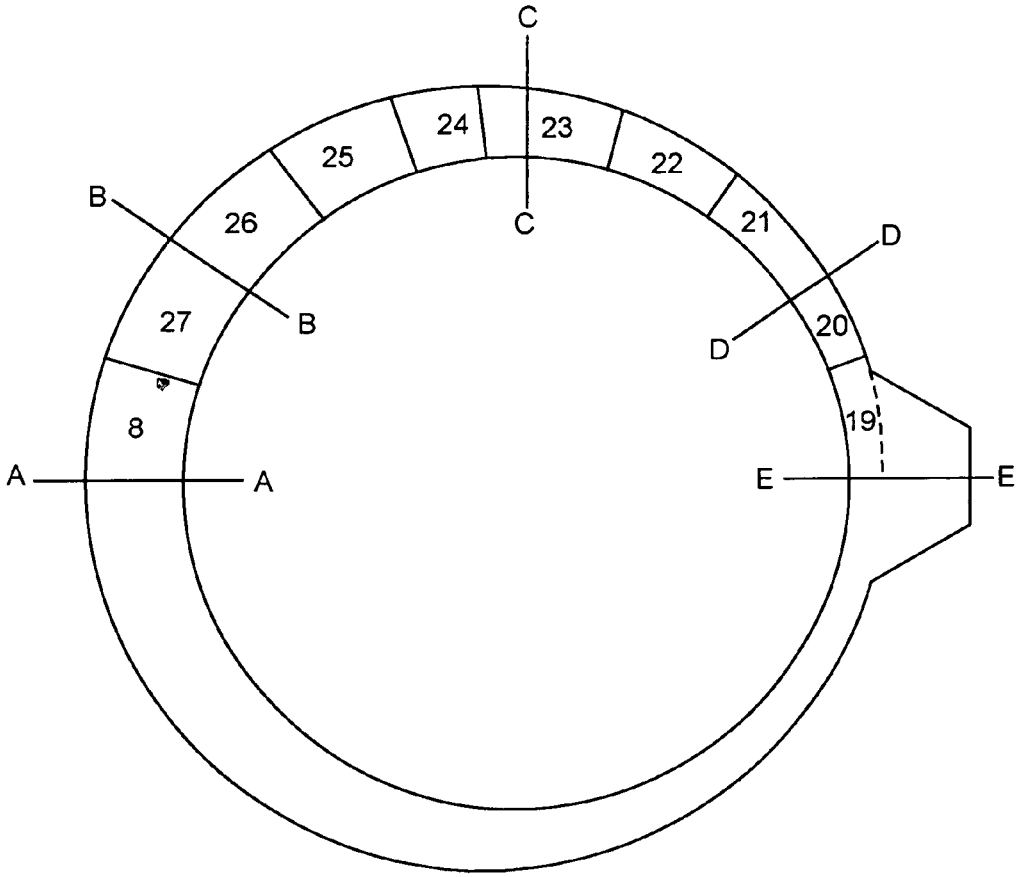
FIG. 8 provides a cross-section of a leaf of the inductor for force analysis.

Finally, a voltage drop for each of the materials may be calculated, with reference to FIG. 8 and the numbered sections. The section numbers are obtained from a computer Lorentz force calculation and they designate 18 degree sections of the toroid leaf. The numbers start at the bucking cylinder (9 degrees at the center plane of the section), with number 19, go up to number 27 (153 degrees at the center plane of the section), and end with number 8 (171 degrees at the center plane of the section). As can be seen, section 8 is out of sequence. The calculated voltage drop through the sections is just the DC voltage drop through the sections due to the required thickness. So, when the thickness is higher, the voltage drop is less because there is a thicker "wire". Because, there is so much current going through the toroid, even small resistances lead to significant energy losses.

Tables summarizing the voltage drops of the various materials may be found in FIG. 9, with Table 4 providing the voltage drop for hard drawn copper (varying leaf thickness), Table 5 providing the voltage drop for hard drawn copper (constant leaf thickness), Table 6 providing the voltage drop for 6061 Aluminum (varying leaf thickness). Table 7 providing the voltage drop for 6061 Aluminum (constant leaf thickness), Table 8 providing the voltage drop for 2014 Aluminum (varying leaf thickness), and Table 9 providing the voltage drop for 2014 Aluminum (constant leaf thickness). In view of the above, the preferred material for the high energy toroidal inductor is the aluminum alloy 6061-T6 due to its light weight and high strength.

Table 10 provides a comparison between the high energy toroidal inductor of the present invention, the segmented toroid (described in the background) and the helical jelly roll toroid (described in the background). As can be seen, toroidal inductors have small external magnetic fields relative to comparable helical inductors and the high energy toroidal inductor of the present invention provides the additional benefits of significantly reduced weight and reduced stray magnetic fields.

As indicated by Table 10, a preferred embodiment of the high energy toroidal inductor of the present invention is designed to be 8 μH with 18 turns. Each turn is constructed by machining a block of 6061-T6 aluminum into the requisite shape; to minimize the electrical resistance there are no welded joints between turns. Notably, each turn is made thick enough to support the electromagnetic forces which act radially outward on each turn. In this way, the toroidal inductor can be made with a similar weight to an equivalent helical inductor since no bracing is needed and can additionally be made with similar reduced magnetic fields to an equivalent segmented toroidal inductor.

TABLE 10

| Inductor Design | Inductance μHenries | Max Current, kAmp | Weight, kg | Space Claim, $m^2$ | Stray Field @ 10 in standoff Tesla |
|---|---|---|---|---|---|
| Helical Jelly Roll | 5.5 | 150 | 18 | 0.0083 | 1–5 |
| Segmented Toroid | 60 | 100 | 122 | 0.14 | 0.2 |
| High Energy Toroidal | 8 | 150 | 17 | 0.0033 | 0.3 |

The present invention may be embodied in other specific forms without departing from the essential attributes thereof; therefore the illustrated embodiments should be considered in all respects as illustrative and not restrictive.

What is claimed:

1. A method of assembling a toroidal inductor, wherein said inductor includes a plurality of leaves and a bucking cylinder, said plurality of leaves comprising a twisted ring configuration having a first end offset from a second end, the method comprising the steps of:

inserting a top portion of each of said plurality of leaves into one of a plurality of slots about a circumference of said bucking cylinder;

securing each of said plurality leaves to the next proximate one of said plurality of leaves; and securing a support ring to said plurality of leaves, wherein said support ring is presented in a position concentric with said bucking cylinder.

2. The method of claim 1, wherein said step of securing comprises securing a top support ring to said plurality of leaves and securing a bottom support ring to said plurality of leaves.

3. The method of claim 1, wherein said top portion of each of said plurality of leaves comprises the narrowest portion of each of said plurality of leaves.

4. The method of claim 1, wherein said plurality of leaves and said bucking cylinder are of an aluminum alloy.

5. The method of claim 1, wherein the assembled toroidal inductor creates a stray magnetic field at a 10 inch standoff of less than 0.5 Tesla.

6. A high energy toroidal inductor, comprising:

a bucking cylinder, having a predetermined circumference; and a plurality of leaves, wherein each of said plurality of leaves is of a single, identical configuration having a varying thickness, wherein each of said plurality of leaves includes a plurality of definable sections, wherein said varying thickness along each section is selected to support electromagnetic forces that act radially outward on each of said plurality of leaves; wherein each of said plurality of leaves comprises a twisted ring configuration having a first end offset from a second end and wherein said plurality of leaves interface with each other and said bucking cylinder to create a substantially continuous toroid about said bucking cylinder.

7. The inductor of claim 6, wherein said bucking cylinder includes a plurality of slots wherein said slot are configured to receive the thinnest portion of each of said plurality of leaves.

8. The inductor of claim 6, further comprising a support ring, wherein said support ring is secured to at least one of said plurality of leaves.

9. The inductor of claim 6, wherein said bucking cylinder and said plurality of leaves are manufactured from an aluminum alloy.

10. The inductor of claim 6, wherein said high energy toroidal inductor creates a stray magnetic field at a 10 inch standoff of less than 0.5 Tesla.

* * * * *